US006245979B1

(12) United States Patent
Campbell

(10) Patent No.: US 6,245,979 B1
(45) Date of Patent: Jun. 12, 2001

(54) FLOATING STACCATO WAFFLE DISK

(75) Inventor: James Campbell, Lexington, KY (US)

(73) Assignee: J. D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 09/466,612

(22) Filed: Dec. 17, 1999

(51) Int. Cl.[7] ..... G10D 13/02

(52) U.S. Cl. ..... 84/411 M; 84/411 R; 84/415; 84/417

(58) Field of Search ..... 84/411 M, 411 R, 84/415, 417, 418

(56) References Cited

U.S. PATENT DOCUMENTS 5,493,942 * 2/1996 Wolf ..... 84/411 R
5,986,196 * 11/1999 Behrenfeld ..... 84/411 M

* cited by examiner

*Primary Examiner*—Shih-Yung Hsieh
(74) *Attorney, Agent, or Firm*—Alix, Yale & Ristas, LLP

(57) ABSTRACT

A drum insert comprising a thin, flexible sheet of material having an overall area substantially congruent with that of the bottom drum head, and a multiplicity of irregularities, preferably holes, distributed substantially uniformly over at least about 20% of the area of the sheet.

28 Claims, 1 Drawing Sheet

FLOATING STACCATO WAFFLE DISK

BACKGROUND OF THE INVENTION

The present invention relates to drums, and in particular to damping or muffling devices for snare drums.

Particularly when used in marching bands, the snare drum ideally exhibits a sharp stick articulation which is, however, diminished noticeably by unwanted overtones from the snare side drum head, particularly if the drum head includes Kevlar reinforcing.

SUMMARY OF THE INVENTION

It is, accordingly, an object of the invention to improve the snare drum so as to retain the player's stick articulation, by eliminating or significantly diminishing unwanted overtones over a wide range of tuning.

In one embodiment, the invention is directed to a drum insert comprising a thin, flexible sheet of material having an overall area substantially congruent with that of the bottom drum head, and a multiplicity of irregularities distributed substantially uniformly over at least about 20% of the area of the sheet.

In another embodiment directed to an improved snare drum, the insert is in the form of a muffler disk lying freely on the upper side of the bottom drum head within the drum volume. The disk comprises a thin, flexible sheet of material substantially congruent with the lower drum head, and having a multiplicity of irregularities distributed substantially uniformly thereon for damping the vibration of the bottom and drum head when the top drum head is struck during play.

Preferably, the sheet material of the insert is a polymeric film having a thickness of about 10–20 mils, and in particular, the material can be a polyester film having a thickness of about 14 mils. In general, the flexible material used as the insert is capable of absorbing and dampening the accepted range of a marching snare drum. The insert is preferably made of the same material as the snare side drumhead.

The irregularities can be in the form of holes, preferably of varying size, occupying at least about 20% of the overall area of the insert. In an alternative embodiment, the irregularities can be raised and lowered regions, formed as by heat stretching or embossing of the film material.

Because in use, the insert remains flexible even at its periphery, no standing vibrations are generated which could otherwise give rise to extraneous noise not normally associated with snare drums. However, with the preferred feature of retaining a substantially uninterrupted, solid rim around an inner region which exhibits the irregularities, the overall circular shape of the insert is retained even during vigorous movement and play of the drum during marching. In the preferred embodiment, in which the irregularities are holes of differing size, the insert is so flexible as to bend substantially vertical when held at the periphery.

BRIEF DESCRIPTION OF THE DRAWINGS

These and other features and advantages of the invention will be evident from the following description of the preferred embodiment, in which.

DESCRIPTION OF THE PREFERRED EMBODIMENT

Figure 1:
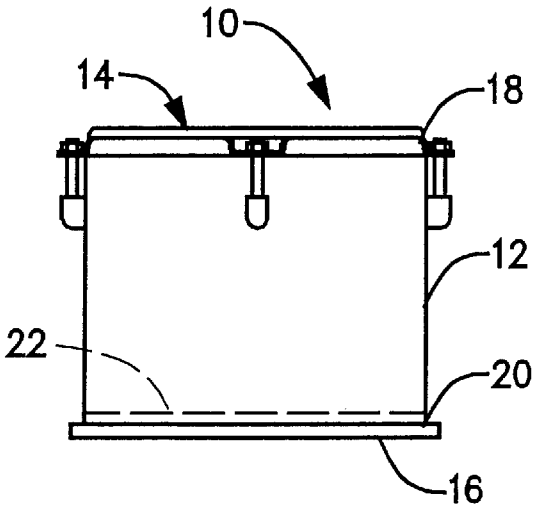
FIG. 1 is an elevation view of a typical snare drum which embodies the invention.

FIG. 1 shows a snare drum 10 having a substantially cylindrical, hollow frame 12, a top drum head 14 and a bottom drum head 16, which are secured to the frame 12 annularly such as indicated at 18 and 20, respectively, to establish a tight configuration which encloses a drum volume therein. The drum has a typical diameter in the range of about 13–15 inches (i.e., radius of about 6.5 - 7.5 inches). The securing means 18, 20 can tighten the drum heads to varying degree, thereby "tuning" the drum.

Figure 2:
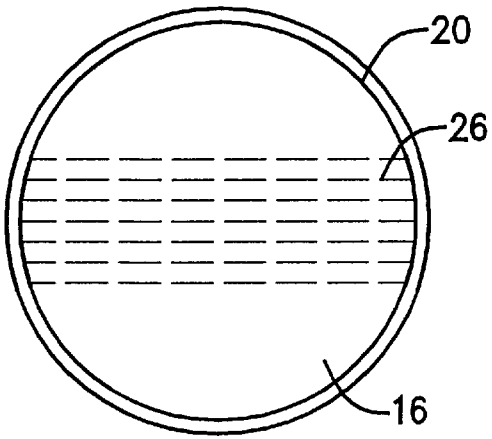
FIG. 2 is a top view of the snare drum of FIG. 1, with the top drum head and insert according to the invention removed.

The upper side of the drum head 14 is struck by the player to produce the well-known snare drum sound. The unique "snare" sound is in large part due to the snare wires or strands associated with the bottom drum head 16. As may be seen in FIG. 2, which is a view of the upper surface of the lower drum head 16, a plurality of snare wires 26 (shown in phantom) span the underside of the lower drum head 16.

Figure 3:
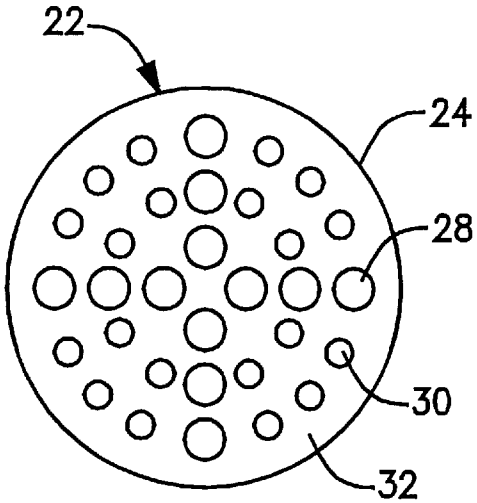
FIG. 3 is a plan view of a first embodiment of the insert of the present invention.

A special drum muffling or damping insert 22 according to the invention is shown in FIG. 1. The insert 22 lies freely on the upper surface of the lower drum head 16. A plan view of the preferred embodiment of the insert is shown in FIG. 3. The insert 22 is substantially circular, such that the diameter or perimeter 24 closely matches the inside diameter or inside circumference of the frame 12 and lower drum head 16. The drum 10 as shown in FIG. 1, would be configured by placing the insert 22 through the open cylindrical frame 12 so that the insert 22 is substantially congruent with the upper surface of the lower drum head 16, lying freely thereon. Thereafter, the upper drum head 14 would be secured in place in a manner well known in the art, as indicated at 18.

With further reference to FIG. 3, the insert 22 has a multiplicity of irregularities thereon, preferably an array of relatively large cut-outs, in particular circles 28, and an array of relatively smaller cut-outs, in particular circles 30. The number of cut-outs should be at least about ten, dispersed generally uniformly over the area of the insert 22, but preferably an outer margin 32 is maintained such that all of the irregularities are within about 90% of the radius of the insert.

In the embodiment shown in FIG. 3, wherein the irregularities are circular, the radius of each hole ranges from about 5% to about 15% of the radius of the insert 22. In general, however, it is preferred that each cut-out, whether or not circular, have an area that is in the range of about 0.5% to about 2.0% of the area of the insert 22. More generally, the irregularities should cover at least about 20%, preferably 20%–35% of the area of the insert 22.

The insert is preferably a polymeric film having a thickness in the range of about 10–20 mils but it is especially preferred that the film or sheet material be the same as or similar to the material used as a major constituent of the bottom or snare side drum head 16. The problem addressed by the present invention is particularly noticeable when the bottom drum head 16 is a Kevlar reinforced polyester sheet material but also arises when the bottom drum head is a homogeneous polyester material, e.g., as available under the trademark Mylar. Thus, the preferred sheet material is also polyester, having a thickness of about 14 mils. The thickness is substantial enough to dampen frequencies in the range of a marching snare drum, which are not permitted to resonate due to the irregularities. The flexibility is sufficient for the mechanical energy of the vibrating head to be absorbed by flexuring, but the irregularities assure that a range of frequencies are preferentially absorbed, and that no resonances are generated.

Figure 4:
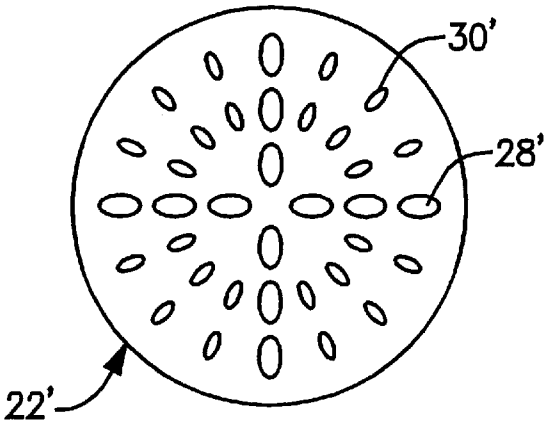
FIG. 4 is a plan view of a second embodiment of the invention.

FIG. 4 shows another embodiment of the insert 22', in which the cut-outs are in the form of elongated slits such as 28' 30'. It can be appreciated that other types of cut-out regions can be utilized and one or another may be preferred for a particular type or set-up of snare drum.

Figure 5:
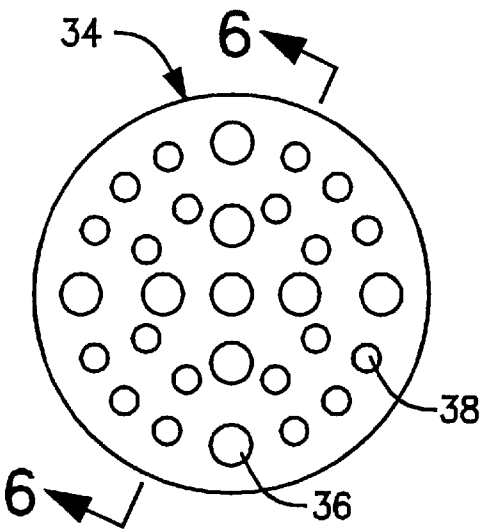
FIG. 5 is a plan view of a third embodiment of the invention.
Figure 6:
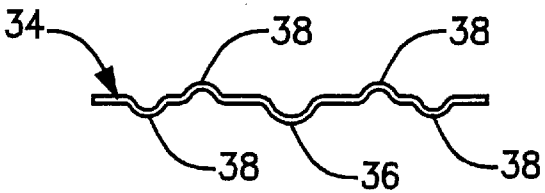
FIG. 6 is a section view taken along line 6—6 of FIG. 5.

FIG. 5 shows a third embodiment 34, which relies on a slightly different principle. The overall number and size of the irregularities 36,38 can vary from or be similar to those shown in FIG. 3, except the irregularities are not cut-outs, but rather regions of raised or lowered material. This is shown in the section view of FIG. 6. Although this embodiment has the disadvantage of relatively less contact between the insert and the upper surface of the bottom drum head 16, it nevertheless, may be advantageous under certain circumstances, e.g., depending on the sound quality desired by the drummer. It should, therefore, be understood that irregularities other than cut-out regions may be employed without departing from the spirit and scope of the invention. For example, elliptical or oval slits extending to and interrupting the perimeter may also be useful, but this may affect the integrity of the "circle" during vigorous activity.

What is claimed is:

1. An insert for lying freely placement on the lower drumhead within a snare drum having a drumhead radius in the range of about 6.5–7.5 inches, wherein the insert consists of a thin, flexible, circular sheet of polymeric film material having a radius in the range of about 6.5–7.5 inches, thereby defining an overall area substantially congruent with that of said drumhead, and at least ten cut-outs distributed substantially uniformly over at least about 20 percent of said area.

2. The insert of claim 1, wherein the sheet material has a thickness in the range of about 10–20 mils.

3. The insert of claim 1, wherein all the cut-outs are within a circular area having a radius that is no greater than about 90 percent of the radius of the circle.

4. The insert of claim 1, wherein the sheet material is a polyester film having a thickness of about 14 mils and the cut-outs are circular holes.

5. The insert of claim 4, wherein the holes are of varying size.

6. The insert of claim 5, wherein each hole has a radius in the range of about 5 to 15 percent of the radius of the sheet.

7. The insert of claim 1, wherein each cut-out has an area that is in the range of about 0.5 to about 2.0 percent of the area of the sheet.

8. The insert of claim 1, wherein the sheet material is polyester film and the cut-outs are distributed over about 35 percent of said area.

9. A snare drum comprising:

a substantially cylindrical frame having a frame diameter and top and bottom ends;

a bottom drumhead attached to the bottom end of the frame and having upper and lower sides;

a top drumhead attached to the top end of the frame whereby an enclosed drum volume is defined;

snare wires spanning the lower side of the bottom drumhead; and a muffler disk lying freely on the upper side of the bottom drumhead within said drum volume, said disk comprising a thin, flexible sheet of material substantially congruent with the lower drumhead, and having a multiplicity of irregularities distributed substantially uniformly thereon for damping the vibration of the bottom drumhead when the top drumhead is struck during play.

10. The drum of claim 9, wherein the sheet material is a polymeric film having a thickness in the range of about 10–20 mils.

11. The drum of claim 9, wherein the irregularities are cut-out regions in the sheet.

12. The drum of claim 10, wherein all the irregularities are within a circular area having a diameter that is no greater than about 90 percent of the diameter of the sheet.

13. The drum of claim 9, wherein the sheet is a polyester film having a thickness of about 14 mils and the irregularities are holes.

14. The drum of claim 13, wherein the holes are of varying size.

15. The drum of claim 14, wherein the holes are circular and each has a diameter in the range of about 5 to 1 5 percent of the diameter of the sheet.

16. The drum of claim 14, wherein each hole has an area that is in the range of about 0.5 to about 2.0 percent of the area of the sheet.

17. The drum of claim 9, wherein the sheet is polyester film and the irregularities are cut-outs.

18. The drum of claim 9, wherein the irregularities include at least about 10 cut-out regions.

19. A drum comprising:

a substantially cylindrical frame having a frame diameter and top and bottom ends;

a bottom drumhead attached to the bottom end of the frame and having upper and lower sides;

a top drumhead attached to the top end of the frame whereby an enclosed drum volume is defined; and a muffler disk lying freely on the upper side of the bottom drumhead within said drum volume, said disk comprising a thin, flexible sheet of material substantially congruent with the lower drumhead, and having a multiplicity of irregularities distributed substantially uniformly thereon for damping the vibration of the bottom drumhead when the top drumhead is struck during play.

20. The drum of claim 19, wherein the sheet material is a polymeric film having a thickness in the range of about 10–20 mils.

21. The drum of claim 19, wherein the irregularities are cut-out regions in the sheet.

22. The drum of claim 19, wherein all the irregularities are within a diameter that is no greater than about 90 percent of the diameter of the sheet.

23. The drum of claim 19, wherein the sheet is a polyester film having a thickness of about 14 mils and the irregularities are holes.

24. The drum of claim 23, wherein the holes are of varying size.

25. The drum of claim 24, wherein the holes are circular and each has a diameter in the range of about 5 to 15 percent of the diameter of the sheet.

26. The drum of claim 24, wherein each hole has an area that is in the range of about 0.5 to about 2.0 percent of the area of the sheet.

27. The drum of claim of 19, wherein the sheet is polyester film and the irregularities are cut-outs.

28. The drum of claim 19, wherein the irregularities include at least about ten cut-out regions.

* * * * *